United States Patent [19]

Baladjanian et al.

[11] 3,961,910

[45] June 8, 1976

[54] RHODIUM-CONTAINING SUPERALLOY COATINGS AND METHODS OF MAKING SAME

[75] Inventors: Gregor Baladjanian, Santa Monica; Eugene V. Clark, Northridge, both of Calif.

[73] Assignee: Chromalloy American Corporation, New York, N.Y.

[22] Filed: Jan. 8, 1975

[21] Appl. No.: 539,391

Related U.S. Application Data

[63] Continuation-in-part of Ser. No. 364,035, May 25, 1973, abandoned, which is a continuation-in-part of Ser. No. 160,013, July 6, 1971, abandoned, which is a continuation-in-part of Ser. No. 115,251, Feb. 16, 1972, abandoned.

[52] U.S. Cl. ..... 29/197; 427/383; 427/405; 427/253; 204/38 S

[51] Int. Cl.[2] ..... C23C 9/02; C23F 17/00

[58] Field of Search ..... 427/252, 253, 383, 191, 427/192, 405; 29/197, 183.5; 204/38 S; 148/6.14

[56] References Cited

UNITED STATES PATENTS

| | | | |
|---|---|---|---|
| 3,494,748 | 2/1970 | Todd | 29/194 |
| 3,677,789 | 7/1972 | Bungardt et al. | 427/252 |
| 3,692,554 | 9/1972 | Bungardt et al. | 427/252 |

*Primary Examiner*—Ralph S. Kendall
*Attorney, Agent, or Firm*—Fitch, Even, Tabin & Luedeka

[57] ABSTRACT

Superalloy structures, such as high temperature components for jet engines and the like, are provided with aluminum-containing diffusion coatings enabling guantum extensions of service life through unique distributions therein of rhodium. The rhodium is predifused into the alloy structure, and the resultant distribution minimizes aluminum migration into the structure and thus maximizes protective coating performance.

19 Claims, 4 Drawing Figures

NICKEL PLATING

RHODIUM-CONTAINING SUPERALLOY COATINGS AND METHODS OF MAKING SAME

REFERENCE TO RELATED APPLICATIONS

This application is a continuation-in-part of our earlier application Ser. No. 364,035 May 25, 1973, now abandoned, which is a continuation-in-part of our copending application Ser. No. 160,013, filed July 6, 1971, now abandoned, which in turn is a continuation-in-part of application Ser. No. 115,251, filed Feb. 16, 1971, now abandoned.

BACKGROUND OF THE INVENTION

1. Field of the Invention.

This invention has to do with a significant discovery in the field of metallurgy. More particularly the invention is concerned with obtaining improved performance from superalloy components through the provision of diffusion coatings capable of multiplying their presently expectable service life. The invention finds its novelty in diffusion-coated superalloy components, and methods for their preparation.

The invention in its essentials is a deparature from previous efforts at improved diffusion coatings for superalloys which have been directed at ever more durable oxides of metals, in that, in large measure, the benefits of the invention flow from the rejection of oxygen by rhodium, that is, its characteristic inability to form stable oxides at expected service temperatures, e.g. above 900°C.

The products of the invention have been occasioned by the inexorable advance of jet engine design in a quest for more efficiency, higher thrust and longer service life. The former requirements are achievable by use of increased temperatures within the hot section of the engine, but increased use temperature accelerates those processes which in time degrade the engine components, i.e. processes such as corrosion and thermal fatigue, thus shortening service life.

2. Prior Art.

Critical components of jet engine hot sections such as turbine blades, nozzle guide vanes, burner components and like structures are cast, forged, machined, or otherwise fabricated of superalloy materials, i.e. materials in which the base metal is nickel or cobalt to provide a "nickel base" or "cobalt base" alloy, respectively, which is characterized by great strength at elevated temperatures. These structures are ofen diffusion-coated with a material typically and predominantly aluminum, which characteristically forms a binary Ni-Al or Co-Al alloy, known as a nickel aluminide or cobalt aluminide alloy, with the superalloy nickel or cobalt base metal, respectively. Aluminum has the capacity to form highly stable, even refractory, oxide layers at the operating temperature of hot section components which are highly adherent and cohesive and thus effective to block incursions of corrosive chemical agents into the superalloy structure, so long as the $Al_2O_3$ layer is intact. However, disruption of the aluminum oxide layer is followed by further oxidation and, subsequently, corrosion of the superalloy.

The aluminum oxide layer is subject to mechanical stress by the different rates of thermal expansion and contraction of the superalloy substrate and the diffusionproduced aluminide layer lying under the oxide layer. This stress may be aggravated by loss of base metal cations through the diffusion coating which leaves incomplete, and thus stressed, base metal crystal lattices beneath the diffusion coating.

As indicated, workers in the art have sought to incorporate one or another material into diffusion coatings to form more thermally stable or more tenaciously adherent corrosion-resistant surfaces on superalloy structures.

Improvement made this way has been incremental and has not contributed significantly to extending the life of components beyond the present aluminide coating.

One problem has been the migration of aluminum into the base metal structure and from the coating. This migration decreases the amount of aluminum available in the diffusion coating to form the refractory oxide which is the principal mechanism of superalloy structure protection. Limiting aluminum migration inward from the coating will greatly prolong coating life and correspondingly extend the service life of coated parts such as turbine blades.

SUMMARY OF THE INVENTION

It has now been found that an order of magnitude improvement in corrosion resistance of diffusion-coated alloy structures, e.g. to enable service lives of up to 15,000 hours and beyond, is achieved with the use of rhodium in the aluminum diffusion coating, and more specifically by establishing a rhodium-rich inner boundary layer in the diffusion coating which is restrictive of aluminum inward migration. Rhodium appears to be unique in its ability to provide such an effect.

More particularly, the invention provides a cobalt or nickel base superalloy structure, such as a jet engine component, having a diffusion coating consisting essentially of the base metal, i.e. cobalt or nickel, aluminum and rhodium, the inner boundary portion of this coating comprising predominantly rhodium. Rhodium is a cation source, being a polyvalent metal having a valence greater than the base metal and accordingly acting to reduce the valence state of base metal cations, $Ni^{++}$ or $Co^{++}$, and it has no stable oxides at service temperatures, e.g. temperatures of 900°C. and higher, so that rhodium rejects oxygen at service temperatures. The whole of the diffusion coating typically contains from 15 to 40 weight percent aluminum, and it may be a ternary alloy system of nickel or cobalt and aluminum and rhodium. Preferably the whole of the diffusion coating comprises 5 weight percent up to 50 weight percent of rhodium, and ternary alloy streams may typically contain from 10 to 30 percent by weight rhodium, between 15 and 40 percent by weight aluminum and the balance base metal and metallic elements, if any, initially associated with the base metal in the superalloy structure. Uniquely, an innermost boundary layer portion of the diffusion coating, having a thickness which is equal to between about 5% and 20% of the ultimate diffusion coating depth, is relatively richer in rhodium than other portions of the coating, and it may contain above 50% by weight rhodium and at least four times as much rhodium as aluminum by weight. This is characteristic of coatings formed by first depositing a rhodium surface coating having a thickness equal to between about 5% and 20% of the total ultimate diffusion coating depth and then prediffusing the rhodium into the superalloy under a nonoxidizing, nonreactive atmosphere at temperatures between about 1400°F. and 2350°F.

The invention contemplates a method of forming a diffusion coating on a nickel base or cobalt base alloy structure by first applying an adherent layer of rhodium, which is a relatively slowly diffusing metal, onto the surface to be coated, e.g. by plating, electroplating, painting, sputtering, vacuum or vapor depositing and the like, to a suitable thickness, e.g. about 5% to 35% pf the intended diffusion coating case on the structure. The rhodium is then prediffused into the alloy, and thereafter aluminum which is a relatively rapidly diffusing metal is finally diffused into the alloy structure. The aluminum may be diffused into the alloy structure from a diffusion coating pack in which the structure is immersed, or by a slurrying process, or aluminum may be deposited upon the prediffused structure, by any processes mentioned for applying rhodium, and then suitably diffused thereinto.

There is obtained in accordance with the invention, novel alloy systems which have a diffusion coating containing cobalt or nickel, aluminum and rhodium possibly together with quite minor amounts, e.g. from less than 0.5 to 5% by weight other metallic elements initially present, if any, in the alloy structure, wherein there is a predominantly rhodium alloy system at the inner boundary of the diffusion coating.

Figure 1:
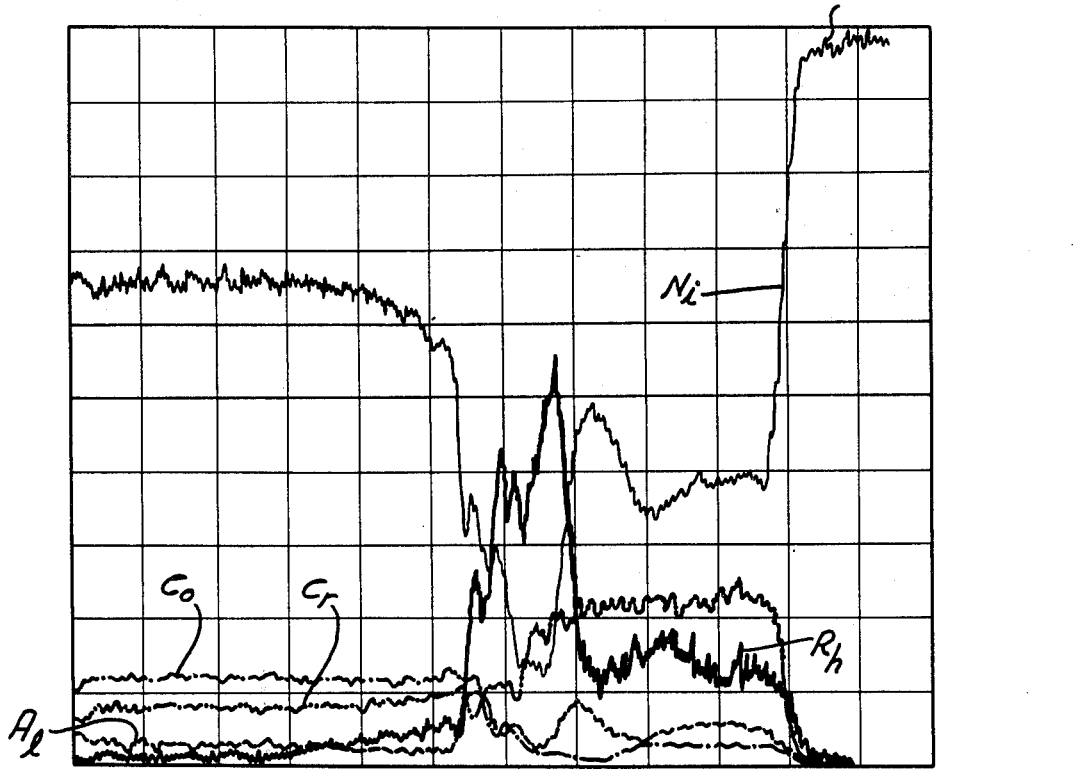
FIG. 1 is a microprobe scan of a nickel base alloy structure coating containing rhodium illustrating the formation of an inner diffusion barrier.

Cast or otherwise formed structures of superalloys, such as those listed, have in the past been protected in their use environment, e.g. jet engine hot sections, through the formation of intermetallic compounds, namely nickel aluminides and cobalt aluminides, formed by diffusing aluminum into the structure from a diffusion pack. These aluminides are a source of adherent protective oxides during use of the structure by providing aluminum oxide layers which suppress rapid oxidation and corrosion of the base metal structure. These coatings, sometimes augmented with minor amounts of specific metal additives, lose their protectiveness, partially through exfoliation, or breaking away, of the oxide layer and partially through loss of aluminum which appears to interdiffuse with the matrix constituents. Aluminum loss from the coating zone means lower concentration aluminum phases, and these phases oxidize at accelerated rates. Accordingly, efforts to improve coatings are aimed at more tenacious adherence to reduce exfoliation and reduced aluminum diffusion through the use of diffusion barrier.

Chromium has been used as a diffusion barrier additive as well as a corrosion inhibiting additive to alloys, at increased use temperature, e.g. 1900° or 2000°F and higher, however, the solubility of chromium is enhanced and its diffusion rate increased to the point that it tends to break down as a barrier to aluminum diffusion at these temperatures. Yttrium oxide layers are tenacious and show promise as protective layers, but they are limited in use quantity because of a low melting eutectic with nickel and high interdiffusion properties between nickel and yttrium.

In a departure from the conventional practice of seeking ever more adherent or stable oxide forming metals for incorporation into superalloy structures, the present invention employs rhodium in order to intentionally reduce the probability of forming stable oxides at service temperatures, which herein is considered to be 900°C, and above, up to the limits of the alloys coated. Remarkable extensions to service life have been realized through this radical approach, which, while not fully understood, evidently is successful because of its characteristic provision of cations at elevated use temperatures and the presence of a barrier layer of predominantly rhodium at the inner boundary between the coating and the structure substrate. Without desiring to be limited thereto, it may be theorized that these cations, by their substitution for base metal atoms, relieve the electrical gradient normally existing across the diffusion coating barrier, which gradient has tended to draw base metal atoms outward to be replaced by inwardly interdiffusing aluminum, which inward interdiffusion of aluminum in turn left the diffusion coating reduced in aluminum content and thus more oxidation-prone. In addition, the presence of rhodium atoms reduces the rate of inward diffusion of oxygen and outward diffusion of oxidizing aluminum and base metal cations.

Accordingly, the present invention provides an additional cation source within the diffusion coating on a superalloy structure. Plainly, the need for an added cation source is at those elevated service temperatures where metal atom diffusion is likely, about 900°C. and above. Metals forming stable oxides at these elevated temperatures will not be satisfactory for this purpose because they do not provide reduction in the valence state of the base metal cations or substitute cations for the base metal. Among various metals which might be used as cation donors at very high temperatures, Group VIII metals of the Periodic Table of Elements lying below nickel and cobalt, particularly rhodium, iridium and platinum are noteworthy. Of these three metals, however, only rhodium has been found to form an interior barrier to inward migration of aluminum; and thus, rhodium is demonstrably superior to iridium and platinum.

Rhodium is first coated onto the superalloy structure surface to be protected and then prediffused into the structure. Electroplating of rhodium is a highly successful technique. Sputtering, immersion, vapor and vacuum deposition, painting of powder suspensions and formation in situ of rhodium from a decomposable rhodium compound can also be used to coat the structure surface with rhodium. The thickness of the initial rhodium deposit should be equal to between 5 and 35 percent of the ultimate depth of the diffusion coating. Because of the cost of rhodium, it is usually used in an amount between 5 and 20 percent of the case depth; however, preferably an amount of at least about 10 percent of the depth is employed. The rhodium coating is first diffused into the superalloy part under an inert or nonreactive nonoxidizing atmosphere e.g. under vacuum, hydrogen, nitrogen, or some other oxygen-free atmosphere, such as helium, argon or other of the rare gases, and prediffusion is usually carried out at between about 1400°F. and 2350°F. for a suitable time interval. Generally, prediffusion is performed for at least one hour at between about 1900°F. and 2100°F. Following prediffusion, the part is subjected to pack treatment to add aluminum and a diffusion pack of the conventional type may be employed. As a result of this prediffusion, an inner boundary region is created in the final product wherein rhodium is the major component of the alloy and the rhodium content is significantly larger than the aluminum content, for which condition we employ the word "predominant" herein.

Pack diffusion per se is well known and basically comprises heating the metals to be diffused in surface contact with the superalloy part (into which surface diffusion is to be effected) at an elevated temperature and for a relatively extended time in a suitable vessel, such as a metal box. Conventionally, and in the application of the novel compositions of the present invention, an inert diluent is present in the box as is an activator or transport compound, and oxygen is excluded. The pack ingredients are relatively fine powders and may include as the inert diluent refractory materials available in powdered form, preferably about 50 to 350 U.S. Mesh, e.g. various aluminum compounds including clays and aluminum oxides as well as zirconia, magnesia and other polyvalent metal oxides. The activator is generally a halogen or halogen-percursor compound. Thus, fluorine, chlorine, bromine and iodine per se and in salt form, particularly alkali metal and alkaline earth metal and ammonia salt forms from which they are readily releasable, are useful as activators. The pack composition may be widely variable. A typical pack composition may contain about 72 weight percent $Al_2O_3$ as an inert diluent, about 8 weight percent of aluminum metal, about 20 weight percent chromium, and about 0.2 weight percent activator, e.g. $NH_4HFH$. After an initial conditioning cycle at 1800°F. for 8 to 12 hours and replenishment of activator, pack diffusion is completed by heating the part in the pack at a temperature above 1750°F. for about 8 to 12 hours.

It has been ascertained that an essentially ternary alloy system is formed by the above-described diffusion. A microprobe scan of aluminum, nickel and rhodium provides the curves shown in FIG. 1. It will be noted that there is a distinct alloy system formed of the nickel, aluminum and rhodium as indicated by the shape of the respective curves.

A Microprobe is a quantitative tool for determining the percentage of each elemental constituent in a solid substance, it can be seen that the outer coating depicted in FIG. 1 is essentially made up of an alloy consisting of nickel, aluminum and rhodium. A series of experiments where the concentration of rhodium was varied in the coating, revealed that the secondary elements such as chromium and cobalt remained relatively unchanged, however, the scans of Al, Ni, and Rh varied in a continuous manner and therefore indicated the primary importance of these three elements and the formation of an alloy system consisting essentially of aluminum, nickel or cobalt and rhodium with minor amounts, less than 5% by weight of the coating, of other elements present in the superalloy, such as cobalt and chromium as depicted in FIG. 1.

The rhodium barrier layer is clearly seen in FIG. 1, and it is noted that rhodium is distributed differentially through the depth of the diffusion coating so as to predominate among the metals at the inner boundary layer of the coating and provide the protective advantage explained herein. In general, the rhodium will comprise from 10 to 80% by weight of the metal in the inner boundary layer portion of the coating which portion may be considered to generally extend a distance equal to from about 5% to about 20% of the total depth of the coating. The rhodium will generally be present in this portion in a weight amount of at least twice and often four times the amount of aluminum, the balance being made up of other alloying elements.

Figure 2:
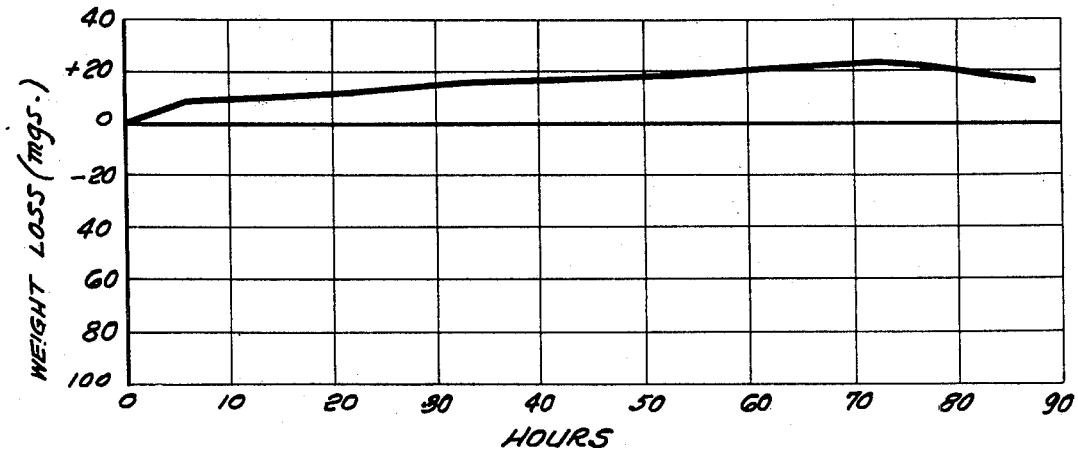
FIG. 2 is a graphical depiction of the performance, measured by weight loss, of the coating of FIG. 1 in a test rig, testing being terminated after 90 hours and only incipient failure.

The significance of the just noted distribution of rhodium is reflected in consideration of FIG. 2 where the part bearing the coating depicted in FIG. 1 is tested for resistance to corrosion and erosion in a test rig by alternately heating and cooling the part, while subjecting it to centrifugal force stresses, aqueous salt spray and sulfur-enriched (JP-5) fuel. Weight loss (in milligrams) is an indicator of coating life in this test. In FIG. 2, it will be noted that there was no weight loss, even some gain, after 90 hours of testing; the test was then discontinued.

Figure 3:
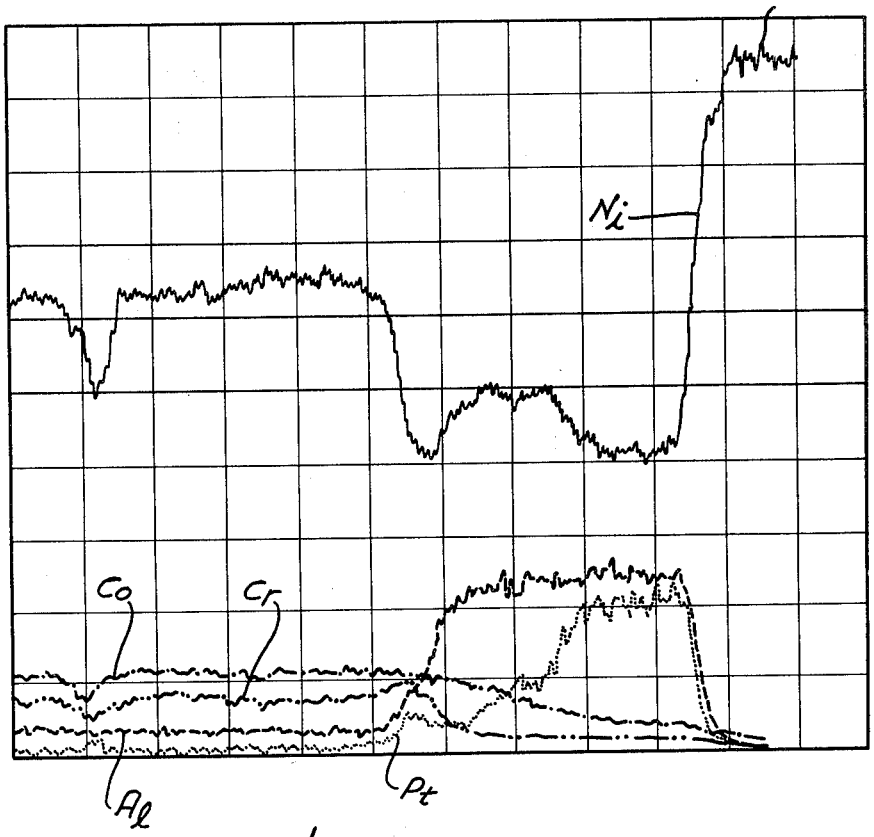
FIG. 3 is a microprobe scan of a nickel base alloy structure coating containing platinum.
Figure 4:
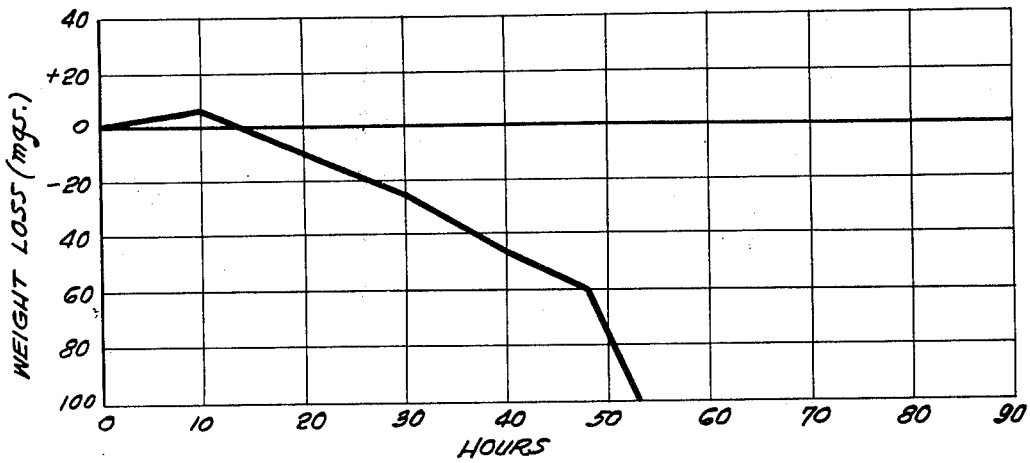
FIG. 4 is a graphical depiction of the performance, measured by weight loss, of the coating of FIG. 3, in a test rig, testing being terminated after 57 hours, following failure.

FIG. 3 is a microprobe analysis of a coating wherein platinum has been substituted for rhodium in the coating depicted in FIG. 1. The weight loss of this coating, when subjected to the same testing as indicated above, is depicted in FIG. 4. This platinum-containing coating did not exhibit the diffusion-limiting stability that rhodium-enriched coatings exhibit. The clear superiority of rhodium over platinum in this coating system is evident from a comparison of FIGS. 2 and 4.

EXAMPLE I

To illustrate the production of coated parts in accordance with the invention and the present coating method, a test specimen in the approximate shape of a turbine blade cast from B 1900 nickel base alloy is cleaned, as for a metal plating operation, by abrasive blasting and degreasing. The cleaned blade is prepared and immersed in a rhodium plating bath and subjected to a current of about 15 amps/square foot for 30 minutes to realize a 0.0006 inch (0.015 mm) rhodium plate. Following removal from the bath and an acetone wash, the blade is placed in a vacuum furnace at about 2075°F for two hours. Thereafter, the rhodium-prediffused blade is water-washed and acetone-degreased, and it is placed in a commercial diffusion pack containing aluminum, chromium, halide activator and $Al_2O_3$ diluent. After subjecting the part in the pack to 1900°F. for 15 hours, the part has a diffusion coating of 0.0031 inch in depth or a "case" of 3.1 mils (0.79 mm).

Analysis of the coating by Microprobe scan is illustrated in FIG. 1 and indicates an alloy system of rhodium, aluminum and nickel with small additions of chromium and cobalt in the near surface portion of the diffusion coating.

EXAMPLE II

The coating whose Microprobe scan is shown in FIG. 3 is prepared using a B 1900 nickel base alloy structure shaped like a vane, cleaned as in Example I, electroplated with platinum to a depth of 0.18 mil, and prediffused under vacuum at 2100°F. for 2 hours. The plated, prediffused structure is placed in the same type diffusion pack as in Example I and heated at 1800°F. for ten hours to obtain a case of 3.2 mils, directly comparable to the 3.1 mil case in Example I.

Each of the coated vanes is then subjected to erosion testing. Results are summarized in Table I below and graphically presented in FIGS. 2 and 4.

EXAMPLE III

A test specimen like that in Example I was electroplated with rhodium to a thickness of 0.2 mil. The part was placed in argon and heated at 1900°F. for 1 hour to prediffuse the rhodium plate into the part surface. Depth of the rhodium-enriched layer is 1.0 mil.

This part is aluminum diffused using the same pack as in Example I. Erosion testing shows that a useful coating is obtained.

TABLE 1

| Hrs. | Ex.I Loss, mg. | Remarks | Ex.II Loss, mg. | Remarks |
|---|---|---|---|---|
| 0 | 0 | Smooth,uniform no defects | 0 | Surface smooth, uniform, silvery no defects |
| 6 | 0 | Dark gray oxide | — | |
| 10 | — | | | Smooth, gray oxide |
| 16 | 0 | Dark gray - brown oxide | | |
| 20 | — | | 11 | Smooth gray oxide |
| 23 | 0 | Dark gray - brown oxide | | |
| 30 | — | | | Light oxide flaking |
| 33 | 0 | Dark gray - brown oxide | 24 | |
| 40 | — | | 45 | Light oxide flaking |
| 43 | 0 | Greenish-gray oxide | | |
| 47.5 | — | | 61 | Oxide scale spots; & blue-gray oxide |
| 53 | 0 | Greenish-gray oxide | | |
| 57.5 | — | | 141 | Moderate erosion;failure (test discontinued) |
| 63 | 0 | Greenish-blue oxide, brown oxide | NA | |
| 73 | 0 | Light outer oxide erosion | NA | |
| 78 | 0 | Further outer oxide erosion | NA | |
| 83 | 0 | Further outer oxide erosion | NA | |

NA = Not applicable

EXAMPLE IV

A test specimen like that in Example I was electroplated with rhodium to a thickness of 0.2 mil. The part was placed in a hydrogen atmosphere and heated for 1 hour at 1900°F. to prediffuse the rhodium plate into the part surface. Depth of the rhodium-enriched layer was 1.0 mil.

This part is aluminum diffused using the same pack as in Example I. Erosion testing shows that a useful coating is obtained.

EXAMPLE V

Example IV was duplicated except that air is employed during prediffuson. Oxides of rhodium were noted, and a useful coating was not obtained by aluminum diffusion in a pack of the type employed in Example I.

Inspection of the above data and the Figures reveals the remarkable erosion resistance of the coatings of this invention, particularly over a similar platinum system.

In general, the coatings of this invention are formed upon superalloys and therefore contain nickel or cobalt (base metal), aluminum and rhodium, together with small amounts, generally less than 5 percent in the coating, of other elements present in the superalloy, e.g. chromium, cobalt or nickel (nonbase metal), molybdenum, tungsten, vanadium, titanium, tantalum, boron, columbium and zirconium.

The terms "nickel base" and "cobalt base" herein refer to alloys in which nickel or cobalt, respectively, is the base and thus is the largest single ingredient, in weight percent, although this is not necessarily a major weight portion of the entire alloy. Thus, for example, suitable cobalt base alloys include those composed by weight of cobalt (35–80%) and tungsten (0–25%), chromium (0–40%), iron (0–20%), and/or carbon (0–4%). Among suitable nickel base alloys are those composed by weight of nickel (35–99.5%), chromium (0–25%), iron (0–20%), manganese (0–2%), molybdenum (0–20%), cobalt (0–25%), tungsten (0–5%), as well as vanadium, aluminum, titanium, tantalum, columbium, boron and zirconium. Typical cobalt and nickel base superalloys are set forth in the article entitled "High-Temperature Alloys" in the Kirk-Othmer Encyclopedia of Chemical Technology, 1st Edition, Volume 8, p. 51, the disclosure of which is incorporated herein by reference.

Preferred alloys for high-temperature heat resistance contain from 50–70 weight percent of the base metal and appreciable amounts of metals such as tungsten, molybdenum and chromium.

The present invention is useful in improving the service life of various superalloy structures intended to be used in high-temperature, highly corrosive environments. Thus, turbine engine parts, such as nozzle guide vanes, blades or buckets, fuel nozzle covers, burner components, hot gas ducts, engine shrouds, and valves for steam turbines are typical structures which may advantageously be given diffusion coatings according to the invention.

As indicated, the alloy system diffusion coating formed typically contains from 15 to 40% and usually at least 20% by weight aluminum, from 10 to 35% of rhodium, the balance being base metal, nickel or cobalt and other elements initially present in the superalloy base. The concentration of the rhodium metal in the diffusion coating may be as little as 5% or as great as about 35%; however, an amount of rhodium of at least about 15 weight percent is preferably used. The inner boundary layer has a depth from about 5% to about 20% of the diffusion coating depth or structure case, and this region which appears as a spike on the Microprobe scan may have a rhodium concentration from about 30 to about 80 weight percent. This inner boundary layer results from depositing a rhodium coating on the structure surface in a thickness of between about 5% and about 20% of the ultimate coating depth and prediffusing under an inert or nonreactive, nonoxidizing atmosphere at temperatures between about 1400°F. and 2350°F., preferably 1900°F. to 2100°F.

In summary, the diffusivity of rhodium in the base metal and in the coating is lower than platinum, and this may be one explanation for the production of the inner boundary diffusion barrier. In the temperature range where oxide formation ($RhO_2$, $PtO_2$) is significant, rhodium has the lower vapor pressure of the two oxides, and this may be a partial reason for the difference in the weight gain or loss characteristics of FIGS. 2 and 4. Due to the lower density of the rhodium, approximately one-half that of platinum, the atomic content of the rhodium will be approximately twice as abundant as that of platinum for the same thickness of plating deposited so that rhodium has a cost advantage, for like performance. Commercial rhodium plating is far more available than the platinum plating, and, in addition, rhodium deposits at faster rates than platinum.

Various of the features of the invention are set forth in the claims which follow:

What is claimed is:

1. Method of forming a diffusion coating on a nickel base or cobalt base alloy structure which includes applying onto the structure surface to be coated an adherent layer of rhodium having a depth equal to between 5 percent and 35 percent of the intended depth of the diffusion coated base, prediffusing said rhodium layer into the structure surface under a nonoxidizing nonreactive atmosphere at a temperature between about 1400°F. and 2350°F., and thereafter diffusing aluminum into the prediffused rhodium containing structure surface at an elevated temperature and for a time sufficient to form with the rhodium and base metal said diffusion coating, whereby as a result of said prediffusing said alloy structure has a diffusion coating the inner boundary portion of which is relatively rich in rhodium.

2. Method according to claim 1 including diffusing said aluminum into said alloy structure surface from a diffusion coating pack containing aluminum, said surface being immersed in said pack.

3. Method according to claim 1 including diffusing said aluminum into said alloy structure from a coating thereof deposited onto said rhodium layer.

4. Method according to claim 1 in which said rhodium is vapor deposited onto said structure surface.

5. Method according to claim 1 in which said rhodium is deposited onto said structure surface from a bath containing the metal in which said surface is immersed.

6. Method according to claim 1 in which rhodium metal is applied onto the structure surface by plating, and said plate has a thickness not less than 10% of the intended depth of the diffusion coated case.

7. Method of forming a diffusion coating according to claim 1 wherein said adherent layer of rhodium is applied to have a depth equal to between 5% and 20% of the intended depth of the diffusion coated case.

8. Method according to claim 7 wherein said rhodium layer is prediffused into the structure surface for at least about 1 hour at a temperature between about 1900°F. and 2100°F.

9. Method according to claim 2 in which rhodium plating is effected by electroplating.

10. Method according to claim 1 in which said rhodium is diffused under vacuum.

11. Method according to claim 1 in which said rhodium is diffused under hydrogen.

12. Method according to claim 1 in which said rhodium is diffused under argon.

13. Cobalt or nickel base alloy structure having a diffusion coating, said coating consisting essentially of between 15 and 40 percent by weight aluminum, from 5 to 50 percent by weight rhodium, and the balance base metal, the inner boundary portion of said diffusion coating being between about 5 percent and 20 percent of the ultimate diffusion coating depth and relatively rich in rhodium to contain up to about 80 percent by weight rhodium, said diffusion coating being formed by prediffusing a rhodium coating having a thickness between 5 and 35 percent of said ultimate diffusion coating depth into the structure surface under a nonoxidizing nonreactive atmosphere at a temperature between about 1400°F. and 2350°F., and thereafter diffusing aluminum into the diffused-rhodium-containing structure surface.

14. Alloy structure according to claim 13 in which said rhodium coating to be prediffused is at least 10% of the ultimate diffusion coating depth.

15. Alloy structure according to claim 14 wherein the inner boundary portion of said diffusion coating contains at least four times by weight as much rhodium as aluminum.

16. Alloy structure according to claim 14 in which the alloy is cobalt base.

17. Alloy structure according to claim 14 in which the alloy structure is nickel base.

18. Alloy structure according to claim 13 in which said coating contains from 10 to 30 percent by weight rhodium, 10 to 40 percent by weight aluminum and the balance base metal and metallic elements initially associated with the base metal in the alloy structure.

19. Alloy structure according to claim 13 wherein said rhodium coating which is diffused has a thickness of between 10 and 20 percent of the ultimate diffusion coating depth.

* * * * *

UNITED STATES PATENT AND TRADEMARK OFFICE

CERTIFICATE OF CORRECTION

PATENT NO. : 3,961,910

DATED : June 8, 1976

INVENTOR(S) : Gregor Baladjanian et al.

It is certified that error appears in the above-identified patent and that said Letters Patent are hereby corrected as shown below:

Line 4 of Abstract, "guantum" should be --quantum--.

Column 1, line 50, "ofen" should be --often--.

Column 3, line 7, "pf" should be --of--.

Column 5, line 28, "percursor" should be --precursor--.

Signed and Sealed this

Thirtieth Day of November 1976

[SEAL]

*Attest:*

RUTH C. MASON
*Attesting Officer*

C. MARSHALL DANN
*Commissioner of Patents and Trademarks*